US010077962B1

(12) United States Patent
Dean

(10) Patent No.: US 10,077,962 B1
(45) **Date of Patent: *Sep. 18, 2018**

(54) ONE-PIECE MONOCORE FIREARM SOUND SUPPRESSOR

(71) Applicant: Steven M. Dean, Munford, AL (US)

(72) Inventor: Steven M. Dean, Munford, AL (US)

( * ) Notice: Subject to any disclaimer, the term of this patent is extended or adjusted under 35 U.S.C. 154(b) by 74 days.

This patent is subject to a terminal disclaimer.

(21) Appl. No.: 15/429,044

(22) Filed: Feb. 9, 2017

Related U.S. Application Data

(63) Continuation of application No. 15/098,176, filed on Apr. 13, 2016, now Pat. No. 9,599,421.

(51) Int. Cl.
*F41F 1/00* (2006.01)
*F41A 21/30* (2006.01)

(52) U.S. Cl.
CPC ..... *F41A 21/30* (2013.01)

(58) Field of Classification Search
CPC ..... F41A 21/30; F41A 21/34; F41A 21/325; F41A 21/36; F01N 1/08
USPC ..... 89/14.4; 181/223
See application file for complete search history.

(56) References Cited

U.S. PATENT DOCUMENTS 3,667,570 A * 6/1972 WerBell, III ..... F41A 21/30 181/223
4,576,083 A * 3/1986 Seberger, Jr. ..... F01N 1/08 181/223
5,029,512 A * 7/1991 Latka ..... F41A 21/30 181/223
5,136,923 A 8/1992 Walsh, Jr.
6,722,254 B1 * 4/2004 Davies ..... F41A 21/36 42/1.06
7,073,426 B1 * 7/2006 White ..... F41A 21/30 181/223
7,874,238 B2 * 1/2011 Silvers ..... F41A 21/34 181/223
8,096,222 B2 * 1/2012 Silvers ..... F41A 21/34 181/223
8,978,818 B2 * 3/2015 Proske ..... F41A 21/30 181/223
9,086,248 B2 * 7/2015 Young ..... F41A 21/30
D741,443 S 10/2015 Cheney
(Continued)

*Primary Examiner* — Samir Abdosh
(74) *Attorney, Agent, or Firm* — Lanier Ford Shaver & Payne; Gerald M. Walsh

(57) ABSTRACT

A firearm sound suppressor having a one-piece monocore. The monocore comprises a mainframe and a central channel therein which is connected to the mainframe by support arms which form support chambers. The central channel has a circular central bore, through which a projectile passes, and a rectangular external shape with four sides with openings thereon, wherein each side rotates 60 to 120 degrees around the longitudinal axis of the central bore, forming a helical twist in the central channel. The support chambers are attached to connecting members at the circumference of the mainframe. The support chambers and connecting members form the same helical configuration as the central channel, producing a helical flow of propellant gases, coming out of the openings, from the rear end to the front end of the central channel. Compressed propellant gases are prevented from entering the central chamber in front of the projectile. This design improves sound suppression and accuracy of the firearm.

16 Claims, 4 Drawing Sheets

(56) References Cited

U.S. PATENT DOCUMENTS

| | | | | |
|---|---|---|---|---|
| 2010/0000398 | A1* | 1/2010 | Silvers | F41A 21/30 89/14.4 |
| 2011/0220434 | A1* | 9/2011 | Silvers | F41A 21/30 181/223 |
| 2012/0152649 | A1* | 6/2012 | Larue | F41A 21/30 181/223 |
| 2015/0090105 | A1* | 4/2015 | Pace | F41A 21/30 89/14.4 |
| 2015/0136519 | A1* | 5/2015 | Moore | F41A 21/30 181/223 |

* cited by examiner

ONE-PIECE MONOCORE FIREARM SOUND SUPPRESSOR

CROSS-REFERENCE TO RELATED APPLICATION

This is a continuation application of prior application Ser. No. 15/098,176 filed on Apr. 13, 2016, currently pending.

FIELD OF THE INVENTION

This invention relates to a sound suppressor for a firearm and, more particularly, to a monocore firearm sound suppressor which produces a helical formation of propellant gases along the longitudinal axis of a central channel and directs the gases into a plurality of helically oriented chambers external to the central channel.

BACKGROUND OF THE INVENTION

Firearm sound suppressors work by trapping and delaying the exit of the high pressure muzzle gases from a firearm when the firearm is discharged. Creation of turbulence is one technique used to enhance the trapping of the gases with a subsequent delay in the exit of the gases from a sound suppressor. If a sound suppressor is very effective at trapping and delaying the exit of the gases, this results in a lower sound level coming from the firearm.

Firearm sound suppressors usually feature either use of discrete or individual components or a monolithic construction where the main structure is of one piece. Monolithic construction of a sound suppressor can be performed with computer numerically controlled (CNC) machinery to produce a one-piece core, referred to as a monocore, that has the baffle structure machined from one piece of metal. Sound suppressors that have a monocore with baffles are disclosed in U.S. Pat. Nos. 8,978,818 and 9,086,248.

U.S. Pat. No. 5,136,923 discloses a firearm silencer which includes an outer housing and an interior tube (a central channel) within the housing. The interior tube is spaced from the inside walls of the housing to form an exterior chamber around the interior tube. The interior tube is adapted to receive a projectile discharged from a firearm and extends the entire length of the housing which is attached to a muzzle of a firearm. The interior tube is perforated with a plurality of rows of ports which extend through the wall of the interior tube and discharge into the exterior chamber. The sound suppressing performance of this type of suppressor is considered to be due to the rapid heat exchange between the propellant gases and the surface area of the conductive metal in the suppressor. The efficiency of this type silencer is considered greater on a volume basis for a given projectile clearance than that of baffle silencers. However, because of the limited surface area inherent in this type of design, this type of suppressor is useful only for small fire arms. A sound suppressor of this design having substantially increased surface area for a given volume, for heat dissipation, and that could create greater turbulance of the gases around the length of the interior tube, would be much more effective in suppressing sound and attenuating recoil.

SUMMARY OF THE INVENTION

This invention provides a monocore for a firearm sound suppressor having a mainframe with a front cap, a rear base, and connecting members connecting the rear base to the front cap. A blast baffle is positioned between the rear base and the front cap, with the blast baffle being attached to the connecting members, thereby forming a rear chamber and a front chamber in the mainframe. A central channel is positioned in the front chamber with the central chamber being connected to the blast baffle and to the front cap. The central channel is also connected to the connecting members by support arms. The central channel has a circular central bore and a rectangular external shape with four sides, with each said side having a plurality of openings into the circular bore. The central channel has a front end and a rear end, wherein each side of the central channel rotates progressively 60 to 120 degrees around a longitudinal axis of the central bore of the central channel, from the rear end to the front end, forming a helical twist in the sides of the central channel. The connecting members are evenly spaced around the circumferences of the rear base and the front cap, wherein the point of attachment of the connecting member on the front cap is displaced 60 to 120 degrees around the circumference of the front cap, relative to the point of its attachment on the rear base, thereby giving a helical shape to the connecting members around the circumference of the mainframe. The support arms form support chambers for the openings in the sides of the central channel, with the support chambers forming helical paths for propellant gases, causing the propellant gases to move from the blast baffle to the front cap.

The rear base, the blast baffle, and the front cap each have a circular central bore in alignment with the circular central bore of the central channel, along a longitudinal axis of the mainframe. The connecting members, the central channel, and the support arms are constructed so that compressed propellant gases do not enter the circular central bores of the blast baffle, the central channel, and the front cap in front of a projectile as the projectile is propelled through these circular central bores. The twist or path of the projectile is, therefore, not impeded by compressed propellant gases. The monocore with all its components is, preferably, a one piece unit manufactured from a single piece of metal.

An advantage of this invention is monocore sound suppressor that can be made as a unit from a single piece of metal using a computer numerically controlled machine.

Another advantage is a monocore that can be removed from its case easily for cleaning or maintenance.

Another advantage is a monocore sound suppressor that suppresses recoil more effectively than current sound suppressors.

Another advantage is a monocore suppressor that suppresses sound more effectively than current sound suppressors.

Another advantage is a monocore sound suppressor that provides an accuracy of a firearm, using this monocore sound suppressor, as if the firearm was not suppressed at all.

DETAILED DESCRIPTION OF THE INVENTION

While the following description details the preferred embodiments of the present invention, it is to be understood that the invention is not limited in its application to the details of construction and arrangement of the parts illustrated in the accompanying figures, since the invention is capable of other embodiments and of being practiced in various ways.

Figure 9:
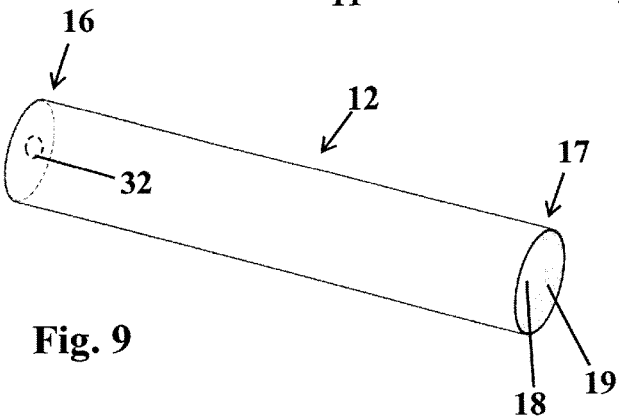
FIG. 9 shows a rear, side perspective view of the case for the one-piece monocore.

The invention of this disclosure is a firearm sound suppressor 10 (see FIG. 1) having a one-piece monocore 11 (see FIG. 6) contained within a case 12 (see FIG. 9). The one-piece monocore 11 comprises a mainframe 13 (see FIG. 3) with a central channel 14 (see FIG. 5). The central channel 14 is connected to the mainframe 13 by support arms 15 (see FIG. 7). The one-piece monocore 11 is manufactured as a single unit from a single piece of metal, preferably, by a computer numerical controlled (CNC) machine which is a computer controlled machining tool well known in the art.

Figure 1:
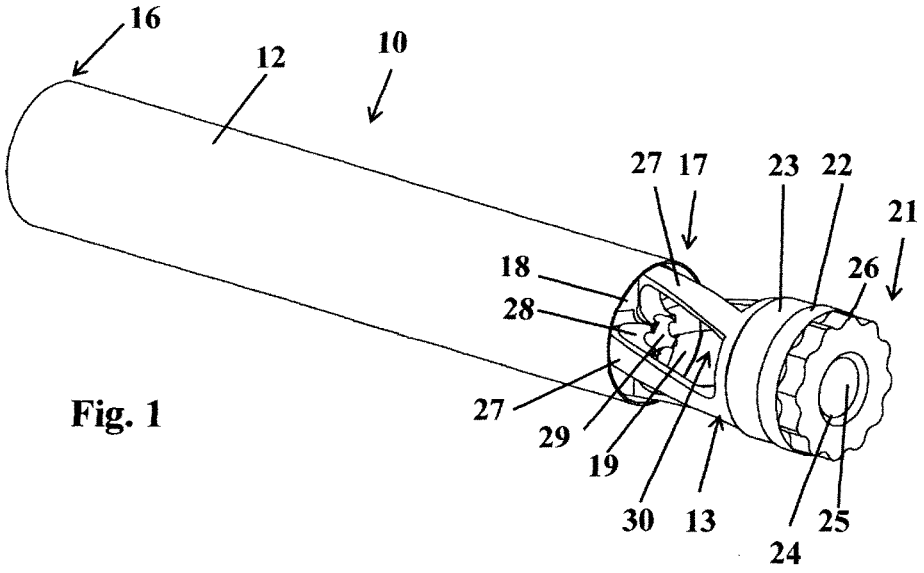
FIG. 1 shows a rear, side perspective view of the sound suppressor of this invention, with a rear portion of a one-piece monocore extending out of its case.

FIG. 1 shows a rear, side perspective view of the sound suppressor 10 of this invention, with a rear portion 21 of a mainframe 13 of the one-piece monocore 11 extending out of its case 12. Case 12 has a front end 16 and a rear end 17 and a hollow interior 18 to receive the monocore 11. The rear end of 21 of the mainframe 13 of the monocore 11 is shown having a base 22 with external threads 23 which engage internal threads 19 in the case 11 to retain the monocore 11 within the case 12. The base 22 has a circular central bore 24 through which a projectile can pass when a firearm is discharged. The central bore 24 has internal threads 25 for attaching the monocore to the muzzle of a firearm. The base 22 has external splines 26 to engage a wrench 31 (see FIGS. 2 and 10) to screw the monocore 11 into case 12. FIG. 1 also shows connecting members 27 and a blast baffle 28 which are shown further in FIGS. 3, 5, and 6. The blast baffle 28 has a circular central bore 29 through which a projectile can pass when a firearm is discharged. The blast baffle 28 and base 22 create a rear chamber 30 in the monocore 11.

Figure 2:
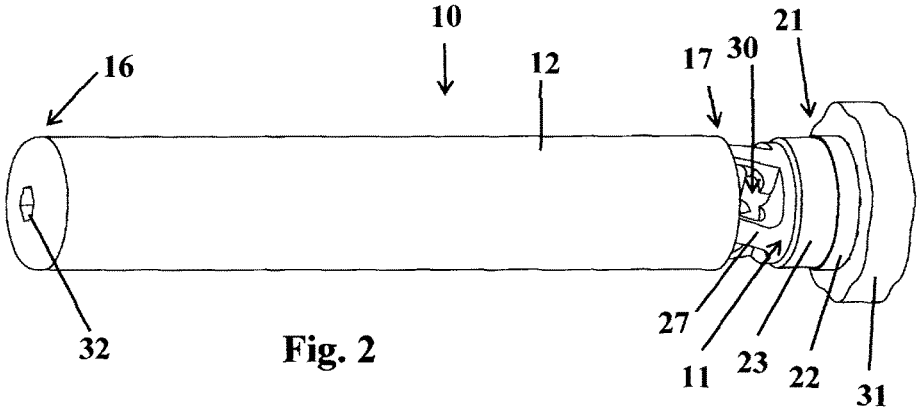
FIG. 2 shows a front, side perspective view of the sound suppressor, with a rear portion of a one-piece monocore extending out of its case.

FIG. 2 shows a front, side perspective view of the sound suppressor, with a rear portion of a one-piece monocore extending out of its case. The front end 16 is closed and has an opening 32 through which a projectile passes when a firearm is discharged.

Figure 3:
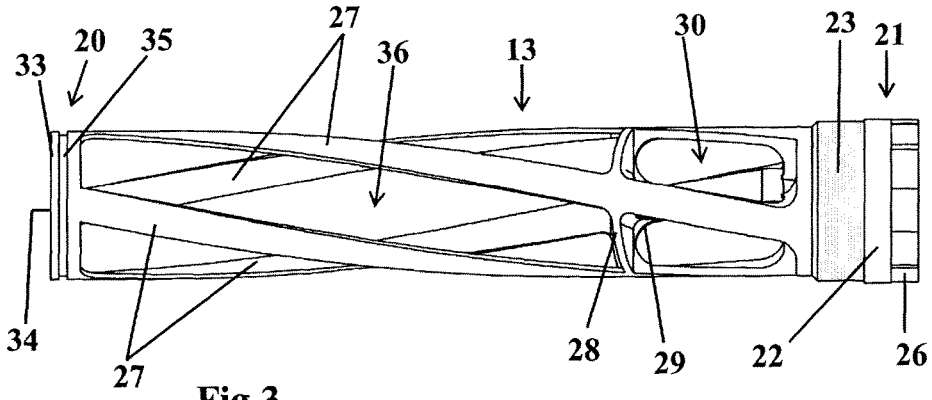
FIG. 3 shows a side perspective view of the mainframe of the one piece monocore.

FIG. 3 shows a side perspective view of the mainframe 13 of the one piece monocore 11. The mainframe 13 has a front end 20 with a front cap 33 having a central bore 34 through which a projectile can pass when a firearm is discharged. The front cap 33 may also have a ring groove 35 to hold an o-ring to form a seal between the front end 20 of the mainframe 13 and the case 11. The base 22 is connected to the front cap 33 with connecting members 27. Preferably, there are 4 connecting members 27 evenly spaced around the circumference of the front cap 33 and the base 22. Each connecting member rotates incrementally 60 to 120 degrees, preferably 90 degrees, from the base 22 to the front cap 33. The point of attachment of the connecting member 27 on the front cap 33 is displaced 60 to 120 degrees, preferably 90 degrees, around the circumference of the front cap 33, relative to the point of its attachment on the base 22. This gives a helical shape to the connecting members 27 around the circumference of the mainframe 13. Proceeding from back to front the connecting members 27 rotate clockwise to the right. However, they can be constructed to rotate counterclockwise to the left. The blast baffle 28 is positioned between the base 22 and the front cap 33, creating the rear chamber 30 and the front chamber 36.

Figure 4:
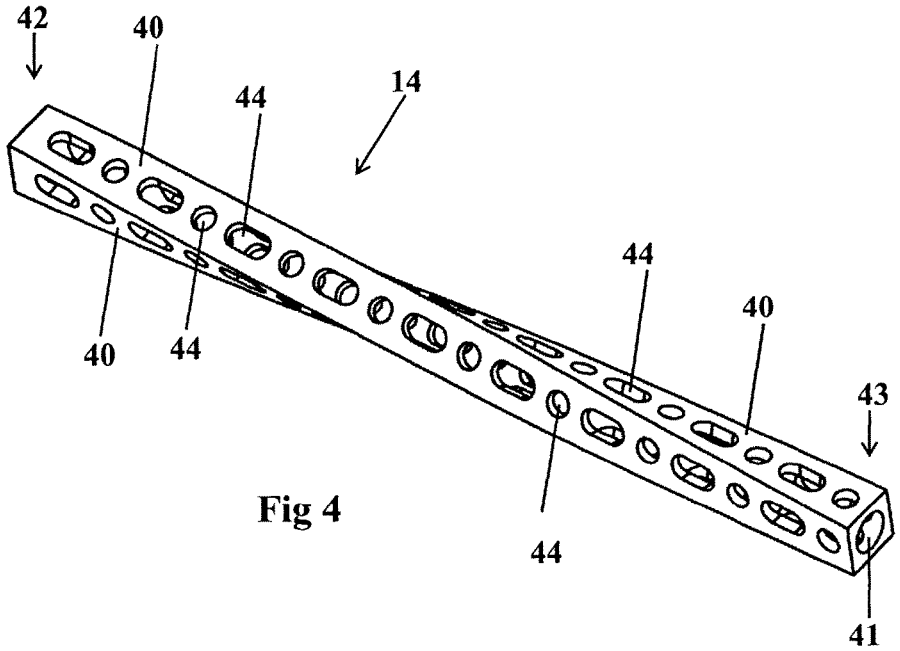
FIG. 4 shows a rear side perspective view of the central channel

FIG. 4 shows a rear side perspective view of the central channel 14 of the monocore 11. The channel 14 has a rectangular shape with four sides 40 and a circular central bore 41 through which a projection can pass when a firearm is discharged. The channel 14 has a front end 42 and a rear end 43. Each side 40 as a plurality of openings 44 along its length through which propellant gases are discharged. Each side 40 rotates progressively 60 to 120 degrees, preferably 90 degrees, around the longitudinal axis of the central bore 41 from the rear end 43 to the front end 42, thus, forming a helical twist in the sides of the central channel 24.

Figure 5:
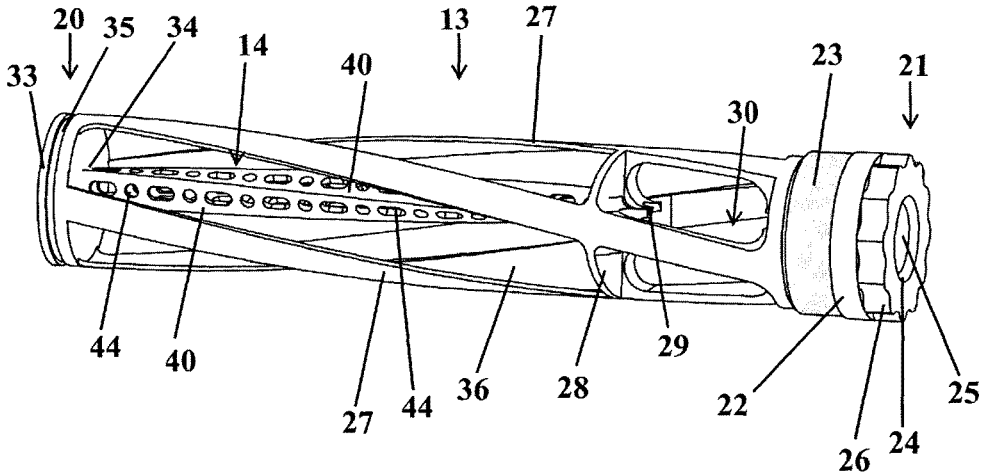
FIG. 5 shows a rear side perspective view of the mainframe and central channel positioned therein.

FIG. 5 shows a rear side perspective view of the mainframe 13 and central channel 14 positioned therein. The circular central bores 24, 29, 41, and 34 of the base 25, the blast baffle 28, the central channel 14, and the front cap 33, respectively, are all in alignment with each other along a longitudinal axis of the mainframe 13 and monocore 11.

Figure 6:
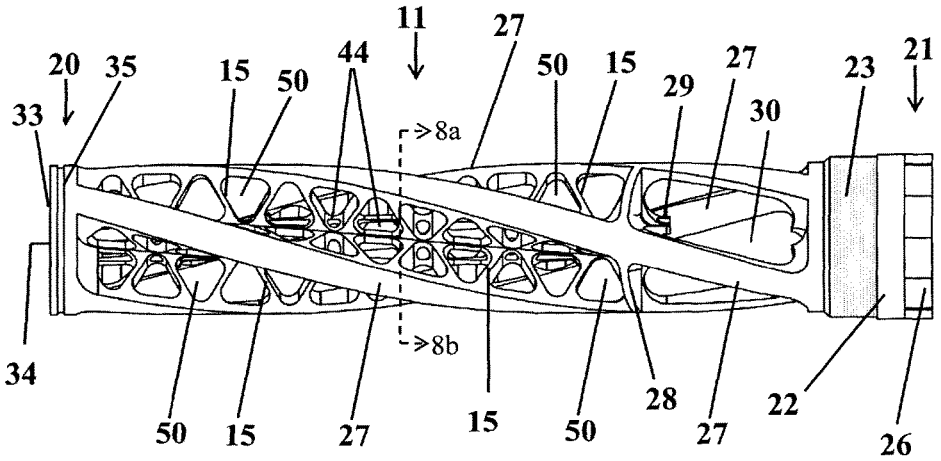
FIG. 6 shows a side perspective view of the mainframe and central channel with support arms connecting the central channel to the mainframe, completing the components of the one-piece monocore.

FIG. 6 shows a side perspective view of the mainframe 13 and central channel 14 with support arms 15 connecting the sides 40 of the central channel 14 to the connecting members 27 of the mainframe 13, completing the components of the one-piece monocore 11. The central channel 14 is connected to the front cap 33 and to the blast baffle 28. There is a support arm 15 on each side of each opening 44 on each side 40 of the central channel 14. The support arms 15 thereby form support chambers 50 for openings 44. Because the support chambers 50 are connected to the sides 40 of the central channel 14 and to the connecting members 27, the support chambers 50 also have a helical orientation around central channel 14.

Figure 7:
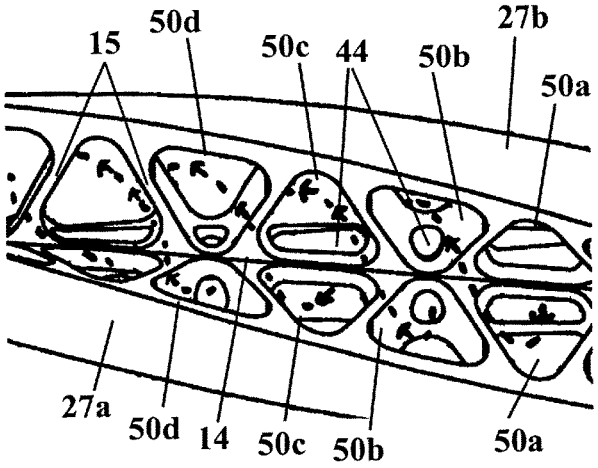
FIG. 7 shows an enlarged side perspective view of the support arms and the support chambers.

FIG. 7 shows an enlarged side perspective view of the support arms 15 and the support chambers 50. The dashed lines illustrate the flow of propellant gases out of the openings 44 of the central channel 14 and through the support chambers 50. The support chambers 50 form helical paths for propellant gases, causing the propellant gases to move from the blast baffle 28 to the front cap 33. FIG. 7 illustrates two connecting members 27*a* and 27*b*, wherein support chambers 50*a*, 50*b*, 50*c*, and 50*d* on connecting members 27*a* and 27*b* extend from a first, second, third and fourth position from the rear end 43 of the central channel 14 towards the front end 42 of the of the central channel 14. Propellant gases entering support chamber 50*a* on connecting member 27*a* flow towards and through support chamber 50*b* on connecting member 27*b*. Similarly, propellant gases flow from support chambers 50*b* and 50*c* on connecting member 27*a* towards and through support chambers 50*c* and 50*d* on connecting member 27*b*, respectively. The propellant gases, thus, circulate in this helical pattern in the front chamber 36 around the exterior of the entire central channel 14, from the rear end 43 to the front end 42. This helical circulation occurs as a result of 1) the helical structure of the central channel 14 and the helical structure of the connecting members 27 and 2) the helical orientation of the support chambers 50.

Figure 8:
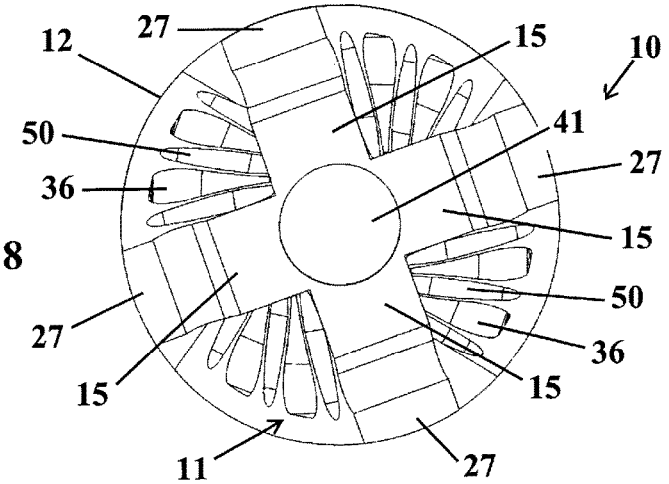
FIG. 8 shows a cross sectional view along line 8*a*-8*b* in FIG. 6.
Figure 10:
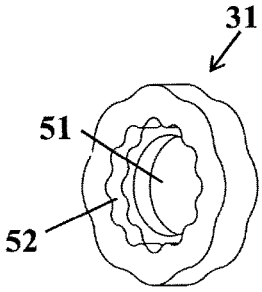
FIG. 10 shows a front, side perspective view of a wrench for fastening the one-piece moncore to the case.

FIG. 8 shows a cross sectional view along line 8*a*-8*b* in FIG. 6. FIG. 9 shows a front, side perspective view of the case 12 for the one-piece monocore 11. FIG. 10 shows a front, side perspective view of a wrench 31 for fastening the one-piece monocore 11 to the case 12, further showing interior splines 52 in the interior 51 of the wrench 31. The interior splines 52 of the wrench 31 engage the exterior splines 26 on the base 22 of the mainframe 13 so that the wrench 31 can screw the monocore 11 into or out of its case 12.

There are unique features in the design of the monocore 11. The entire monocore 11 can be all one piece machined, preferably, from a solid bar of either 7075-T651 aircraft aluminum alloy or grade 5 titanium, using full fourth axis machining methods. The blast baffle 28 delays the flow of propellant gases in the rear chamber 30. The propellant gases pass through the central bore 29 of the blast baffle 28, then pass into the central bore 41 of the central channel 14. The propellant gases then exit the openings 44 in the central channel 14. Since the openings 44 are oriented in a helical pattern around the central channel 14 the propellant gases form a helical pattern of flow as they exit openings 44 and enter the support chambers 50. Since the support chambers 50 are also oriented in a helical pattern around the central channel 14 they further guide the propellant gases in a helical pattern around the central channel 14. These helical structural features provide improved enhancement of the turbulence of the propellant gases by creating paths that cause the propellant gases coming out of the openings 44 to collide with each other. The support chambers 50 delay the flow of propellant gases in the front chamber 36 and provide a greatly improved surface area for the dissipation of heat, resulting in an improved suppression of sound, compared to current sound suppressors. This design of the monocore 11 also avoids having compressed propellant gases in the path of the projectile within the central channel 14. Compressed propellant gases do not enter the circular central bores 29, 41, and 34 in front of the projectile as the projectile is propelled through these central bores. The twist or path of the projectile is, therefore, not impeded by compressed propellant gases. As a result, the accuracy of a firearm using this suppressor is as if the firearm was not suppressed at all.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the monocore can have any desired length or diameter and can be made of any desired metal. The components of the monocore can be made individually and assembled to form the monocore. The monocore can have as many connecting members as desired and they can be made to rotate clockwise or counter clockwise. The central channel can be made to rotate clockwise or counterclockwise. The degree of rotation of the central channel and the connecting members may be more or less than 90 degrees. The openings in the central channel and the support chambers can have any desired shape.

I claim:

1. A monocore for a firearm sound suppressor, comprising:

a) a mainframe having a front end, a rear end, and connecting members connecting said rear end to said front end;

b) a central channel connected to said connecting members by support arms;

c) said central channel having a circular central bore and a rectangular external shape with four sides, each said side having a plurality of openings into said circular bore; and d) said central channel having a front end and a rear end wherein each said side of said central channel rotates progressively around a longitudinal axis of said central bore of said central channel, from said rear end of said central channel to said front end of said central channel, forming a helical twist in said sides of said central channel.

2. The monocore of claim 1, further comprising said connecting members being evenly spaced around the circumferences of said rear end of said main frame and said front end of said mainframe, wherein the point of attachment of said connecting member on said front end of said mainframe is displaced 60 to 120 degrees around the circumference of said front end of said mainframe, relative to the point of its attachment on said rear end of said mainframe, thereby giving a helical shape to said connecting members around the circumference of said mainframe.

3. The monocore of claim 1, further comprising said support arms forming support chambers for said openings in said sides of said central channel.

4. The monocore of claim 3, further comprising said support chambers forming helical paths for propellant gases, causing the propellant gases to move from said rear end of said central channel to said front end of said central channel.

5. The monocore of claim 1, wherein said connecting members, said central channel, and said support arms are constructed so that compressed propellant gases do not enter said circular central bore in front of a projectile as the projectile is propelled through said circular central bore.

6. The monocore of claim 1, wherein said monocore is a one piece unit manufactured from a single piece of metal.

7. A monocore for a firearm sound suppressor, comprising:

a) a mainframe having a front end, a rear end, and connecting members connecting said rear end to said front end;

b) a central channel connected to said connecting members by support arms;

c) said central channel having a circular central bore and a rectangular external shape with four sides, each said side having a plurality of openings into said circular bore;

d) said central channel having a front end and a rear end wherein each said side of said central channel rotates progressively around a longitudinal axis of said central bore of said central channel, from said rear end of said central channel to said front end of said central channel, forming a helical twist in said sides of said central channel; and e) said connecting members being evenly spaced around the circumferences of said rear end of said main frame and said front end of said mainframe, wherein the point of attachment of said connecting member on said front end of said mainframe is displaced 60 to 120 degrees around the circumference of said front end of said mainframe, relative to the point of its attachment on said rear end of said mainframe, thereby giving a helical shape to said connecting members around the circumference of said mainframe.

8. The monocore of claim 7, further comprising said support arms forming support chambers for said openings in said sides of said central channel.

9. The monocore of claim 8, further comprising said support chambers forming helical paths for propellant gases, causing the propellant gases to move from said rear end of said central channel to said front end of said central channel.

10. The monocore of claim 7, wherein said connecting members, said central channel, and said support arms are constructed so that compressed propellant gases do not enter said circular central bore in front of a projectile as the projectile is propelled through said circular central bore.

11. The monocore of claim 7, wherein said monocore is a one piece unit manufactured from a single piece of metal.

12. A monocore for a firearm sound suppressor, comprising:

a) a mainframe having a front end, a rear end, and connecting members connecting said rear end to said front end;

b) a central channel connected to said connecting members by support arms;

c) said central channel having a circular central bore and a rectangular external shape with four sides, each said side having a plurality of openings into said circular bore;

d) said central channel having a front end and a rear end wherein each said side of said central channel rotates progressively around a longitudinal axis of said central bore of said central channel, from said rear end of said central channel to said front end of said central channel, forming a helical twist in said sides of said central channel;

e) said connecting members being evenly spaced around the circumferences of said rear end of said main frame and said front end of said mainframe, wherein the point of attachment of said connecting member on said front end of said mainframe is displaced 60 to 120 degrees around the circumference of said front end of said mainframe, relative to the point of its attachment on said rear end of said mainframe, thereby giving a helical shape to said connecting members around the circumference of said mainframe; and f) said support arms forming support chambers for said openings in said sides of said central channel, said support chambers forming helical paths for propellant gases, causing the propellant gases to move from said rear end of said central channel to said front end of said central channel.

13. The monocore of claim 12, wherein said connecting members, said central channel, and said support arms are constructed so that compressed propellant gases do not enter said circular central bore in front of a projectile as the projectile is propelled through said circular central bore.

14. The monocore of claim 12, wherein said monocore is a one piece unit manufactured from a single piece of metal.

15. A monocore for a firearm sound suppressor, comprising:

a) a mainframe having a front end, a rear end, and connecting members connecting said rear end to said front end;

b) a central channel connected to said connecting members by support arms;

c) said central channel having a circular central bore and a rectangular external shape with four sides, each said side having a plurality of openings into said circular bore;

d) said central channel having a front end and a rear end wherein each said side of said central channel rotates progressively around a longitudinal axis of said central bore of said central channel, from said rear end of said central channel to said front end of said central channel, forming a helical twist in said sides of said central channel; and e) said connecting members being evenly spaced around the circumferences of said rear end of said main frame and said front end of said mainframe, wherein the point of attachment of said connecting member on said front end of said mainframe is displaced 60 to 120 degrees around the circumference of said front end of said mainframe, relative to the point of its attachment on said rear end of said mainframe, thereby giving a helical shape to said connecting members around the circumference of said mainframe;

f) said support arms forming support chambers for said openings in said sides of said central channel, said support chambers forming helical paths for propellant gases, causing the propellant gases to move from said rear end of said central channel to said front end of said central channel; and g) said connecting members, said central channel, and said support arms are constructed so that compressed propellant gases do not enter said circular central bore in front of a projectile as the projectile is propelled through said circular central bore.

16. The monocore of claim 15, wherein said monocore is a one piece unit manufactured from a single piece of metal.

* * * * *